285-376 SR
10/22/85 XR 4,548,265

United States Patent [19]
Luke

[11] Patent Number: 4,548,265
[45] Date of Patent: Oct. 22, 1985

[54] DOWNHOLE STEAM PACKING

[75] Inventor: Mike A. Luke, Houston, Tex.

[73] Assignee: Baker Oil Tools, Inc., Orange, Calif.

[21] Appl. No.: 514,013

[22] Filed: Jul. 15, 1983

[51] Int. Cl.[4] ..... E21B 33/128
[52] U.S. Cl. ..... 166/140; 166/217; 166/387; 285/376; 277/123; 277/234; 277/DIG. 6
[58] Field of Search ..... 166/138, 140, 387, 203, 166/196, 217; 285/267, 376 X; 277/123 X, 124, 234 X, 235 R, 229, 230, DIG. 6 X

[56] References Cited

U.S. PATENT DOCUMENTS

| | | | |
|---|---|---|---|
| 1,915,100 | 6/1933 | McLaughlin | 285/267 |
| 3,392,783 | 7/1968 | Reed | 166/387 |
| 4,281,840 | 8/1981 | Harris | 277/124 |
| 4,296,806 | 10/1981 | Taylor et al. | 166/196 |
| 4,328,974 | 5/1982 | White et al. | 277/DIG. 6 |
| 4,350,346 | 9/1982 | Fowler | 277/DIG. 6 |
| 4,441,721 | 4/1984 | Harris et al. | 277/DIG. 6 |

*Primary Examiner*—Stephen J. Novosad
*Assistant Examiner*—M. Goodwin
*Attorney, Agent, or Firm*—Norvell & Associates

[57] ABSTRACT

A steam or thermal packer for use in subterranean wells having an integral expansion joint is disclosed. The packer has a multi-component, nonresilient, nonenergizing packing element, as well as a multi-component, nonenergizing, nonresilient sealing element engaging the expansion joint. Energy is stored in elements of the packer housing and in the dynamic seal assembly to maintain the sealing integrity establishing by the nonresilient sealing elements.

39 Claims, 5 Drawing Figures

DOWNHOLE STEAM PACKING

BACKGROUND OF THE INVENTION

1. Field of the Invention:

This invention relates to a well tool, such as a packer, used to seal the annulus between inner and outer conduit strings and, more particularly, to a well packer employing nonresilient and nonenergizing packing and sealing elements for maintaining sealing integrity under extreme temperature and pressure conditions, including the presence of saturated steam.

2. Description of the Prior Art:

Conventional subterranean well tools, such packers and bridge plugs, commonly employ annular elastomeric packing elements establishing sealing integrity in the annulus between inner and outer conduits in the well. Conventional packing elements are fabricated from elastomers, such as nitrile. Unfortunately, these conventional elastomers cannot withstand the hostile conditions, such as elevated temperatures and pressures, which can be encountered in some subterranean well environments. For example, in some circumstances it may be necessary to inject saturated steam into a well in order to reduce the viscosity of the crude to facilitate production of the formation fluids. Thermal well tools, such as thermal packers or steam packers, have been employed in such completions to seal the annulus between the production tubing and the casing when steam is injected through the production tubing. Unfortunately, the performance of thermal and steam packers in the presence of the saturated steam injected into the formation has proved to be less than satisfactory. The packing elements used on thermal packers have tended to have a greater leakage rate than desired, and the conventional steam packings employed on thermal packers have tended to deteriorate at an undesirable rate.

A common conventional steam packing used for thermal and steam packers consists of jacketed bulk carbonite packings consisting of fibrous asbestos impregnated with flaked graphite or mica. Asbestos packing elements reenforced with high strength nickel, copper (Monel) wire has also been used as high temperature packing element. These reenforced packing elements have also been impregnated with suitable sealing compounds to increase their usefulness at high temperatures.

In addition to fibrous asbestos seals, thermoplastic seals, such as polytetrafluoroethylene seals, have been used to increase the maximum effective temperature at which sealing integrity can be maintained. Wire mesh extrusion elements have been used on opposite ends of the primary thermoplastic sealing elements to prevent axial extrusion under hostile temperature and pressure conditions. These intermediate hard thermoplastics, such as polytetrafluoroethylene (Teflon), while more resilient than fibrous asbestos, do not possess the resiliency of conventional elastomers, such as nitrile. Attempts have been made to improve the performance of these thermoplastic seals by impregnating asbestos fibers with polytetrafluoroethylene interwoven with a nickel base chromium iron alloy (Inconel) wire. The addition of the asbestos fibers and Inconel wire to form a composite thermoplastic packing element has been intended to improve the resiliency of the thermoplastic members at high temperature. However, there does exist an upper limit at which thermoplastic sealing elements become too plastic to retain significant ability to establish sealing integrity.

The use of nonpolymeric, nonelastomeric seals in geothermal applications under conditions of high temperature and pressure has also been investigated. Laminated graphite seals bonded to metallic rings, such as berilium copper rings to impart resiliency to the graphite, have been tested for use as rotary seals in geothermal applications. Chevron shaped seals formed from powdered graphite cold pressed into a woven metal core have also been tested for use in the same applications. In each case, metallic elements have been added to the graphite sealing structures to impart resiliency to the seals. These composite structures are formed by bonding or intertwining metal members to graphite laminate ribbons formed by cold pressing expanded graphite particles to maintain a compression set in the form of substantially flat flexible integrated graphite sheets or ribbons. The graphite itself is substantially nonresilient and therefore comprises a nonenergizing seal.

In addition to employing high temperature packing elements to establish integrity between the production tubing and the casing of a well, thermal packers also employ dynamic seals acting between inner and outer mutually reciprocal tubular members comprising an integral expansion joint. Integral expansion or slick joints are commonly included in high temperature well tools, such as thermal or steam packers, to account for the expansion and contraction of the production tubing as a result of pressure fluctuations. Normally, thermal or steam packers are first anchored in place and the annular thermal packing elements are radially expanded to establish sealing integrity between the production tubing and the casing. The integral expansion or slick joint is then released relative to the stationary packer. Adequate travel is provided for the integral expansion joint to account for anticipated expansion under high temperature conditions.

SUMMARY OF THE INVENTION

The thermal packer disclosed and claimed herein employs nonresilient, nonelastomeric, non-self-energizing packing and sealing elements and an expansion or slick joint assembly for use in establishing sealing integrity between the production conduit and casing of an oil well in the presence of saturated steam. Both the packing and sealing elements comprise multi-component elements. In the dynamic sealing element the central seal comprises one or more laminate graphite sealing elements. Fibrous elements are then disposed on opposite ends of the central laminate graphite element or elements. In the preferred embodiments described herein, the fibrous packing or sealing elements comprise asbestos or carbon fibers impregnated with powdered graphite. In the preferred embodiment, these fibrous elements are in the form of intertwined fibrous filaments, such as a woven asbestos yarn. Additionally, both the outer packing element and the inner dynamic seal disclosed and claimed herein have wire mesh anti-extrusion rings on each end of the multi-component element. In the preferred embodiment of the packing element, the multi-component element has an annular encapsulating jacket for preventing swab-off or destruction of the laminate and fibrous sealing elements during insertion of the tool into the well. In one embodiment, this annular encapsulating jacket comprises a lead antimony jacket having a melting point lower than the temperature of the saturated steam so that the metallic jacket will melt, thus permitting the multi-component packing elements to establish sealing integrity in the presence of saturated steam. Barrier elements impervious to the passage of steam are also disposed between adjacent laminate or fibrous elements.

Each of the nonresilient, nonenergizing packing and sealing elements are axially loaded in compression to establish sealing integrity between radially spaced tubular members. The outer packing element employs inclined fibrous packing elements disposed on opposite sides of central packing elements having a triangular or trapezoidal cross-section. Axial compression acts to rotate or pivot the outer inclined packing elements to urge the elements outward into contact with the casing. The barrier elements are similarly rotated. The central elements are urged inwardly to firmly establish sealing integrity with the body or mandrel of the packer extending within the annular packing elements. Since the packing and sealing elements are each nonresilient and nonenergizing, additional deformation of either the packing or sealing elements after they initially set can result in leakage. For example, deformation due to an increased pressure differential can lead to leakage when the pressure differential is reduced. The nonresilient, non-energizing character of the packing and sealing elements prevents the elements from returning to a slightly expanded configuration upon reduction of the pressure differential. Both the well tool and the integral expansion joint in the preferred embodiment further comprise stored energy means, such as integral springs, to maintain axial compression on the elements after inelastic deformation in addition to the deformation when the element is initially set.

DETAILED DESCRIPTION OF THE PREFERRED EMBODIMENT

Figure 1A:
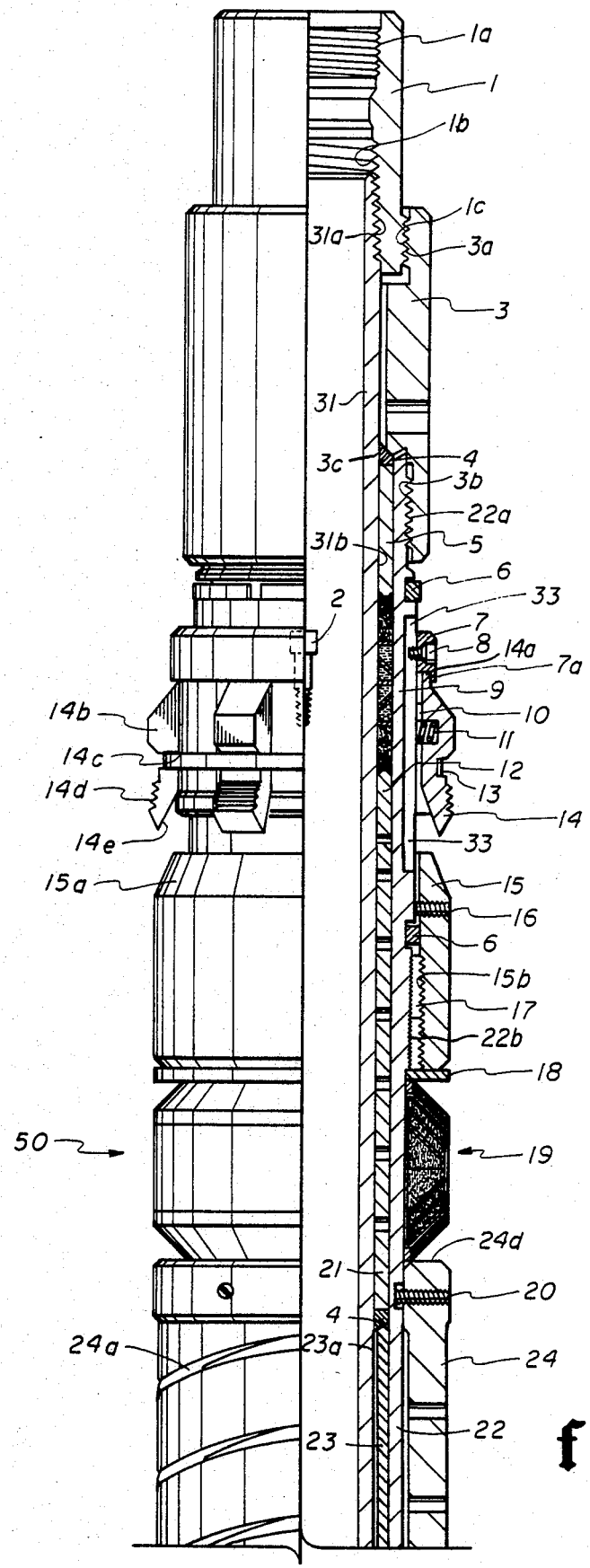
FIGS. 1A and 1B are longitudianl continuations of a steam packer comprising the preferred embodiment of this invention.
Figure 1B:
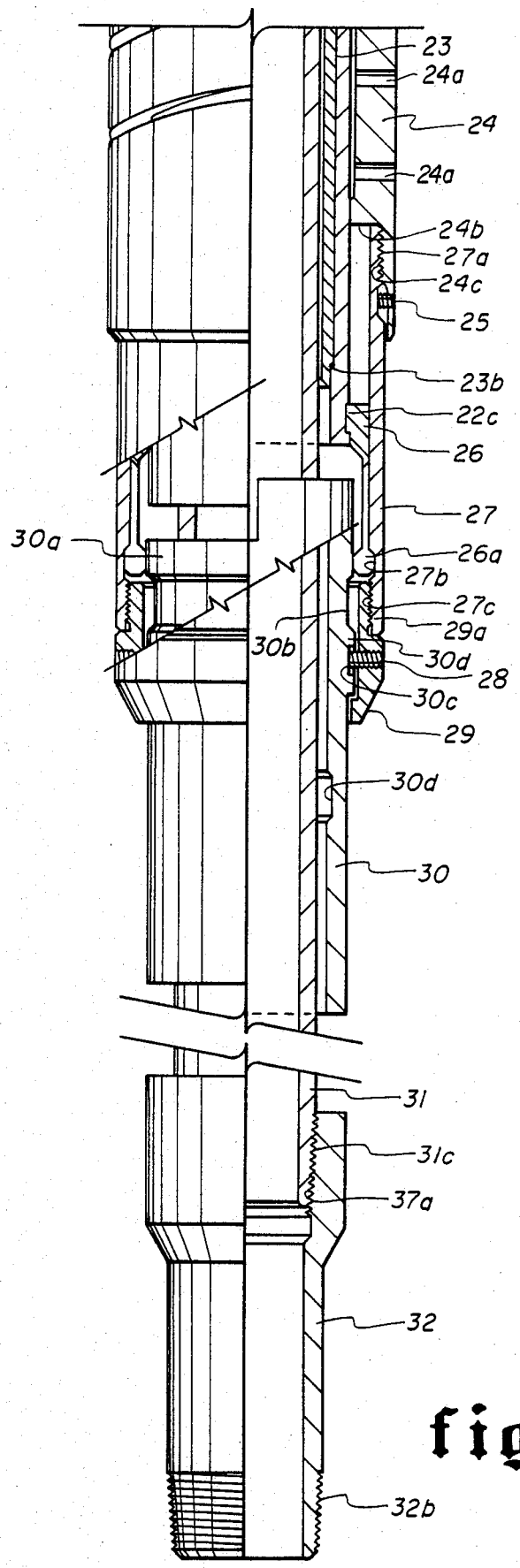

The steam or thermal packer shown in FIGS. 1A and 1B comprises the preferred embodiment of a well tool employing nonresilient, nonelastomeric sealing and packing elements and stored energy elements for maintaining axial compression on the inelastic packing and sealing elements. An anchoring element for securing the tool body and packing element to the outer casing and disengagable integral expansion joint assembly are also included in the packer to permit axial expansion and contraction of the tubing.

Packer 50 has threads 1*a* and 32*b* at the upper and lower ends for attaching the packer to the production tubing string (not shown) in a well. A top sub or interconnecting member 1 is located at the uppermost end of the packer. In addition to tubing threads 1*a*, top sub member has interior thread 1*b* adjacent its lower end. An exterior thread 1*c* is located at the bottom of top sub 1. Threads 1*c* are of an opposite hand from the lower internal threads 1*b*. In the preferred embodiment, threads 1*b* are right hand threads while threads 1*c* are left hand threads. Left hand threads 1*c* are also of an opposite hand from the conventional tubing threads 1*a* at the top of the packer.

Left hand threads 1*c* are attached to mating left hand threads 3*a* at the top of upper body member 3 extending downwardly from the top sub 1. The upper body 3 has internal threads 3*b* located at its lower end above a downwardly facing inner beveled surface 3*c*. Mating pin threads 22*a* on body or mandrel 22 are shown in engagement with the lower threads on body 3. The body or mandrel 22 extends from the upper pin connection 22*a* to a lower groove 22*c* adjacent the base of the packer. Body or mandrel 22 extends within the slip assembly comprising plurality of anchoring slips 14 and the outer or static packing element assembly 19. Immediately below upper pin threads 22*a*, a circumferential groove on mandrel 22 provides for seat of a circumferentially extending pickup ring 6 disposed therein. A longitudinally extending J-slot 33 is located in the periphery of mandrel 22. The profile of J-slot 33 is not shown, but the J-slot is of conventional construction having a first relatively shorter axially extending channel and a second parallel relatively longer axially extending channel joined by a transversely extending channel to form a "J" configuration. The longer axial channel of the J-slot is shown in FIG. 1A.

An anchoring slip assembly comprising a slip stop ring 7, a "J" pin 8, and a plurality of separate rocker type anchoring slips 14 are disposed around mandrel 22 in the vicinity of J-slot 33. The length of the longer portion of J-slot 33 can be seen to be greater than the length of the anchoring rocker type slip assembly. "J" pin 8 is positioned within circumferential slip stop ring 7. The lower portion of "J" pin 8 extends into the channels or groove defining the profile of J-slot 33. Thus "J" pin 8 is free to move only along the path defined by the J-slot 33. Each of the rocker type slips 14 has an upper axially extending protrusion 14*a* received beneath a companion downwardly extending lip 7*a* on the slip stop ring. Thus the upper portion of the rocker type slip is circumferentially retained by the slip stop ring 7. A drag block section 14*b* is located intermediate the ends of each slip 14. The intermediate drag block section 14*b* extends peripherially beyond the remaining portion of the rocker type slips 14 in the relaxed configuration of FIG. 1. The drag block section 14*b* is positioned to remain in sliding contact with the inner wall of a casing into which the packer 50 is inserted, thus urging, rocker type slips 14 to the uppermost extent of their travel as the packer 50 is inserted into the well. Each rocker type slip 14 is urged radially outwardly by a compression spring 11 received within a companion inner groove located in a drag block section 14*b* of the rocker type slip. A lower retaining ring 13 extends around the periphery of the rocker type slip assembly and is received within companion grooves 14*c*. Ring 13 and slip stop ring 7 combine to hold the spring-loaded rocker type slips in position around the periphery of body 22. The lower portion 14*d* of each rocker type slip assembly comprises a wickered gripping section having an inner downwardly facing camming surface 14*e*. The gripping wickers 14*d* on the lower portion of the rocker type assembly are peripherally recessed with respect to the drag block section 14*b* when the slips are in the relaxed configuration of FIG. 1A.

An expander or cone 15 having an upwardly facing camming surface 15a is located in surrounding relationship to mandrel 22 immediately below rocker type slips 14. Expander or cone 15 has wicker type threads 15b on the inner surface adjacent the lower end of the cone 15. These wicker type ratcheting threads 15b are in opposed relationship to wicker type ratcheting threads 22b located around the exterior of body 22. A ratcheting body lock ring 17 is located between ratcheting threads 15b and 22b. In the relaxed configuration of FIG. 1A, the body lock ring 17 is located adjacent the upper portion of the wicker threads 22b. Body lock ring 17 is thus free to travel downward relative to inner mandrel 22, ratcheting along threads 22b. An annular seal spacer 18 is located in abutting relationship with the lower end of cone 15.

An outer or static multi-component packing element 19 is located in surrounding relationship to the intermediate portion of mandrel 22. Annular spacer 18 is located along the upper edge of the relaxed packing element 19. An outer cylindrical housing 24 is located in surrounding relationship with the lower portion of mandrel 22 and the upper surface 24d of housing 24 is opposed to spacer 18 and cone 15 with the multicomponent, nonresilient, nonenergizing packing element positioned therebetween.

Figure 2:
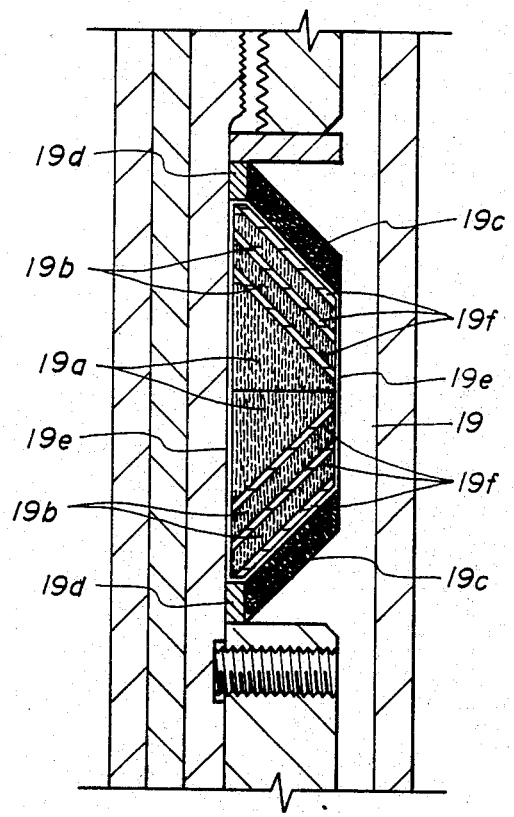
FIG. 2 is a sectional view of the outer packing element employed in the preferred embodiment of this invention in the relaxed configuration.
Figure 3:
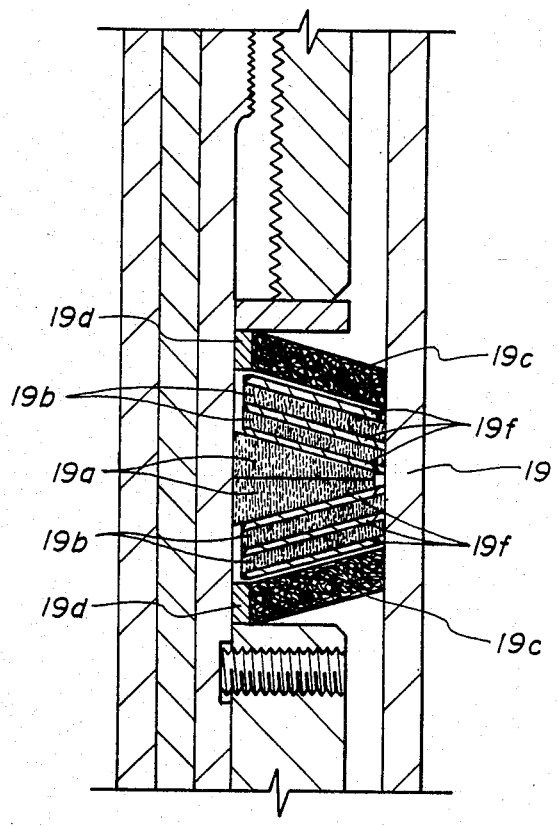
FIG. 3 is a view of the packing element shown in FIG. 4 in the expanded or sealing configuration.

Packing element 19 is a nonresilient, nonenergizing, multi-component packing element. The packing element 19 is shown in more detail in FIGS. 2 and 3. FIG. 2 shows the packing element in the relaxed configuration, while FIG. 3 shows the packing element 19 in its expanded or set configuration. The central components 19a of the packing element comprise two opposed mirror image annular rings. In combination, the central packing element components 19a have a trapezoidal cross-section with outwardly facing inclined upper and lower surfaces. The base of the individual central elements 19a and of the combined elements is wider than the periphery of the central wedge shaped packing elements. In the preferred embodiment of this invention, the centrally disposed packing elements 19a have a fibrous construction in which the fibers are formed into filaments which are in turn intertwined or interwoven. The intertwined filament construction of elements 19a is impregnated with powdered graphite to bridge any interstitial gaps in the filament and to add lubricity to the packing elements 19b. The centrally disposed packing elements are substantially inelastic and non-resilient and are not self-energizing.

A plurality of inclined fibrous packing elements 19b are positioned adjacent the central elements 19a. In the preferred embodiment, the elements 19b have the same fibrous construction as the centrally disposed elements with material impregnating the interstitial gaps. Packing elements 19b are in turn die formed into the non-perpendicular parallelogram cross-section configuration shown in FIG. 2. The fibrous packing elements 19b are also inelastic, nonresilient and nonenergizing. The intertwined filaments of packing elements 19b can comprise carbon yarn or asbestos yarn. In one preferred embodiment of this invention, asbestos yarn is disposed around Inconel wires which add structural integrity to the asbestos filaments.

The outermost elements 19c of the packing element 19 comprise a wire mesh anti-extrusion ring of non-perpendicular cross-section configuration as shown in FIG. 2. Wire mesh rings 19c are positioned adjacent the upper and lower inclined surfaces of the second packing elements 19b. In the preferred embodiment of this invention, the wire mesh 19c can comprise a knitted, endless, intertwined construction. A metal spacer 19d is located beneath the wire mesh 19c on opposite ends of the packing element 19.

In the preferred embodiment of this invention, individual adjacent fibrous packing elements are separated by impermeable barrier elements 19f. Barrier elements 19f comprise solid members generally impervious to the passage of steam or varpors therethrough. In the preferred embodiment of this invention the barrier elements 19f comprise metallic members, ideally formed of a relatively ductile material, such as aluminum. Barrier elements 19f may, however, be formed of other materials, such as plastics or ceramics which maintain integrity and a structure impenetratable to the transport of vapor therethrough at the temperatures and pressures prevelant in thermal downhole operations.

The packing element 19 is encapsulated within an outer jacket 19e extending around component packing elements 19a, 19b and impermeable barrier elements 19f. In one embodiment of this invention, the encapsulating jacket comprises a lead antimony alloy jacket having a melting point less than the temperature of the steam in which the packer is to be operated. The encapsulating jacket maintains the intergrity of the component packing elements disposed therein and prevents deterioration of the packing element as the packer is inserted into a well. The encapsulating jacket also prevents swab-off due to the forces created by the movement of fluids past the packing element during insertion into the well because the pressure of the moving fluids on the exterior of the packing element is less than the stagnation pressure beneath the packing element during movement of the packer into the well. However, the encapsulating jacket disintegrates under operating conditions, for example the lead antimony jacket melts, and sealing integrity is established by the encapsulated elements. Other encapsulating jackets can also be employed. For example, an epoxy encapsulating jacket could also be employed with this packing element.

Cylindrical housing 24 located on the exterior of the packer below packing element 19 is attached to mandrel 22 by means of a conventional shear screw 20. Cylindrical housing 24 has a helical groove 24a extending circumferentially around the housing for a substantial proportion of its length. The housing is elastically stressable when cylindrical housing 24 is subjected to end loads to place the housing in axial compression, the housing acts as a spring member and energy is stored in the housing. The opposing surfaces defining groove 24a are moved together under the influence of axial compression and energy is thus stored in housing 24 for subsequent release to the packing element 19.

Cylindrical spring housing 24 is joined to an outer latch housing 27 at its lower end by means of mating threads 24c and 27a. Latch housing 27 is radially spaced from mandrel 22 to provide clearance for a latching collet 26. Latching collet 26 is received within circumferential groove 22c at the lower end of mandrel 22. Latch collet 26 has a plurality of enlarged collet heads 26a located at its lower ends. These collet heads 26a are radially flexible. In the running-in configuration of FIGS. 1A and 1B the collets are in an expanded configuration. Collet head 26a is received within a circumferential groove 27b on the interior of latch housing 27. A shear sleeve retainer 29 is attached at the lower end of latch housing 27 by means of threaded connections 27c and 29*a*. Shear sleeve retainer 29 additionally receives a threaded shear screw 28 extending therethrough. Shearing sleeve 30 is in turn positioned concentrically within the lower portion of latch housing 27 and within shear retainer 29. A circumferential shoulder 30*d* extends around the periphery of shearing sleeve 30 and defines a groove or hole 30*c* for receipt of the lower portion of shear screw 28 thus securing shearing sleeve 30 to shear sleeve retainer 29 and to the outer portion of the housing of the packer. Shoulder 30*d* engages an opposing shoulder on shear sleeve retainer 29 to prevent downward movement of shearing sleeve 30 relative to the outer portion of the packer housing. A circumferentially extending groove 30*b* is defined above shoulder 30*d* on the exterior of shearing sleeve 30. In the running-in configuration of FIGS. 1A and 1B, the circumferential groove 30*b* is positioned below the latching collet head 26*a* which is held in its expanded configuration in engagement with the groove 27*b* by the exterior of shearing sleeve 30.

Integral tubular expansion joint member 31 is received within mandrel 22 and extends from the upper portion of the upper body 3 through the packer and below the shearing sleeve 30. The tubular expansion joint member or slick joint 31 is attached to the top sub 1 by means of conventional threaded connection at the top of the packer. The top sub 1 is in turn attached to the upper packer body housing 3 by means of the left hand threads 1*c* and 3*a*. As discussed previously, these left hand threads are of an opposite hand from the right hand threads 31*a*. In the preferred embodiment of this invention, slick joint 31 comprises a cold drawn, nonground tubular member. Conventional slick joints used with thermal or steam packers normally comprise a ground and polished tubular member having a smooth outer surface along which sealing integrity is established. A polished surface of this type is, however, expensive to fabricate and difficult to maintain in practice.

Figure 4:
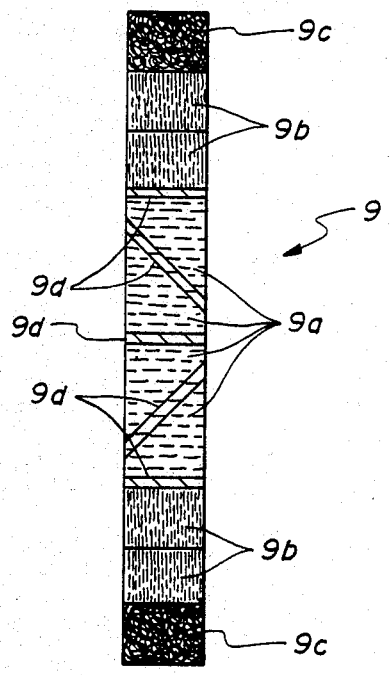
FIG. 4 is a sectional view of the dynamic expansion joint seal in the relaxed configuration.

A dynamic seal between the reciprocal slick joint tubular member 31 and stationary mandrel 22 is maintained by a nonresilient, nonenergizing seal 9 shown in FIG. 1A and depicted in more detail in FIG. 4. The slick joint seal assembly includes a spring 21, shown in FIG. 1A, positioned adjacent the lower end of nonresilient seal assembly 9. Spring 21 comprises a means for storing energy to exert an axially compressive force upon multi-component seal 9. The slick joint seal assembly further comprises an upper scraper 4 at the uper end adjacent the body shoulder 3*c* and a spacer 5 located adjacent the upper end of the multi-component seal 9. A metallic annular spacer 12 is located below the multicomponent nonresilient seal assembly 9 in abutting relationship to spring 21. A lower scraper 14 is located below the spring 21 in abutting relationship with shoulder 23*a* of a packing retainer 23. Packing retainer 23 comprises a tubular member having a lower shoulder 23*b* in abutting relationship with a companion shoulder on packer mandrel 22. The seal assembly is thus trapped between the abutting shoulder 23*b* at the lower end on mandrel 22 and similar upper beveled shoulder 3*c* on body 3. Body 3 is in turn attached to mandrel 22 by means of threaded connection 22*a* and 3*b*. It will be appreciated that multi-component seal 9 thus remains fixed relative to mandrel 22. A desired amount of preload or axial compression can be imparted to multicomponent seal assembly 9 into spring 21 during assembly of the dynamic slick joint seal assembly. After the slick joint 31 and the slick joint seal assembly have been inserted into the bore of packer mandrel 22, the upper body 3 is attached to the mandrel 22. Upper body 3 is also attachable to the slick joint through left hand threads 3*a* and therefore establishes engaging means between an outer conduit or mandrel 22 and the slick joint seals 9. As threads 3*b* and 22*a* are made up or fully engaged, the abutment between beveled shoulder 3*c* and upper scraper 4 applies a compressive load to spacer 5, the dynamic slick joint seal 9 and to spring 21. Spring 21 is compressed, storing energy in the spring. The nonresilient, nonenergizing seal elements comprising slick joint seal 9 are in turn axially compressed, between the biasing members, spring 21 and spacer 5, and sealing integrity is established between the inner surface of mandrel 22 and the outer cold drawn, nonground surface of reciprocal slick joint 31.

FIG. 4 illustrates the dynamic slick joint seal 9 and the individual components can be identified. One or more laminate graphite seals 9*a* are centrally disposed in the multicomponent dynamic seal 9. Laminate graphite sealing elements 9*a* comprise a laminate graphite structure in which expanded graphite particles are cold formed to maintain a compression set. The graphite forms substantially flat, flexible sheets or ribbons which are laminated and die formed into the crosssectional configuration shown in FIG. 4. The laminate graphite elements 9*a* are substantially inelastic and nonresilient and are not energized. An energized seal would expand radially in response to axial compression. Laminate elements 9*a* form opposed trapezoidal sections so that the central laminate segments and the outer laminate segments are urged in opposite radial directions under axially compressive loads. On the opposite side of centrally positioned laminate seals 9*a* are a plurality of fibrous seals 9*b*. These fibrous seals 9*b* can comprise asbestos fiber or graphite fibers with graphite or other bridging material disposed within intertwined fibrous filaments in seals 9*b* to increase the sealing effectiveness and the lubricity of the seals. Each of the component seals 9*a* and 9*b* are die formed in the configuration shown in FIG. 4. The fibrous elements 9*a* and 9*b* are employed to prevent graphite from being carried away by slick joint motion over a period of time. The fibrous elements 9*b* will conform to irregularities in the slick joint surfaces better than the annular wire mesh extension rings 9*c*. The outermost elements of the dynamic seal assembly 9 comprise annular wire mesh rings 9*c* which upon radial compression will serve to prevent axial extrusion of the fibrous and laminate sealing elements 9*a* and the fibrous elements 9*b* in the dynamic seal 9. Barrier elements 9*d*, generally impervious to the passage of saturated steam, are disposed between adjacent laminate or fibrous sealing elements. In the preferred embodiment, these barrier elements can comprise metallic members, such as aluminum or ductile iron. Other materials may, however, be used.

The axial compression applied to packing element 19 and to the slick joint dynamic seal 9 is sufficient to maintain sealing integrity. However, the application of additional axial compression on the nonresilient seal assemblies can result in further deformation of both the packing element 19 and the slick joint seals 9. Such additional axial compressive forces can occur if the pressure differential acting across the packing element 19 and/or the seals 9 is increased. Since the sealing elements employed to maintain sealing integrity at the elevated temperatures in which this packer is to be used cannot return to their initial shape upon reduction of the additional pressure differentials, some means must be provided to maintain an axially compressive force on the packing elements 19 and on the seals 9. The energy stored in cylindrical housing 24 and in the spring 21 can now be used to maintain sufficient axial compression on the deformed nonresilient seal to prevent the loss of dynamic sealing integrity. Note that the energy stored in housing 24 and in spring 21 do not serve to energize the seals or the packing element when the packer is initially set. It is only after subsequent deformation that the stored energy is necessary to maintain an axially compressive force on the deformed seals. In the packer under consideration, any increase in the pressure differentials will occur below the sealed packing elements and seals. An increase in pressure in the annulus below the packer would thus result in additional inelastic deformation of packing elements 19 and seals 9. The force exerted by the stored energy means in housing 24 and spring 21 will act in the same direction as the increased pressure differentials in the annulus below the packer. Therefore, upon reduction of these pressure differentials, the force applied by the housing 24 and spring 21 will act in the same direction as the increased pressure differentials which acted to deform the packing elements and seals and will thus maintain the packing elements and seals in contact to prevent the loss of sealing integrity.

When the packer 50 is to be used in a well, packer 50 with integral slick joint 31 will be run in a well in the position shown in FIGS. 1A and 1B. The top sub 1 and the bottom sub 32 are attached to the tubing string and the packer inserted to the desired position in the well. Note that the drag block section 14 on the rocker slips would be dimensioned to engage the surface of the casing. When the packer has reached the desired position, the tubing string is rotated to remove "J" pin 8 from the short portion of the J-slot. The tubing string and the entire packer are then rotated to align "J" pin 8 with the long portion of the J-slot 33 on the outer surface of the packer. Since the drag block sections **14*b* remain in contact with the casing, the entire packer can be shifted upward relative to the drag blocks 14. The drag blocks will move downward relative to cone 15 with "J" pin 8 moving within the relatively long slot 33. The inner camming surface 14 on the rocker type slips will engage the beveled conical surface 15*a* on cone 15 and the rocker type slips will be cammed outwardly. The gripping elements 14*d* on the exterior of rocker type slips will firmly engage the slips preventing further upward movement of the packer. With the packer thus firmly set, the slick joint 31 can be freed from the packer by disengagement of the left hand threaded connection 3*a* and 1*c*. Slick joint 31 is then free to reciprocate relative to mandrel 22 and relative to packer 50. Slick joint 31 can thus account for thermal expansion and contraction of the tubing string. During movement of the slick joint, the upper and lower scrapers 4 and 12 will remove scale or other deposits from the surface of expansion or slick joint 31. The stored energy present in the housing 24 and spring 21** will also maintain axial compression on the seal if sealing material is lost due to movement of the slick joint.

When the packer is set, the inelastic, nonenergizing components of the packing elements are shifted to establish seaing contact with both the packer mandrel 22 and the exterior casing, as shown in FIG. 3. The packer element is set as a result of movement of the lower shoulder of cone 15 toward the up facing shoulder **24*d* on housing 24. These shiftable members thus comprise seal urging or packing urging members. The inner elements 19*a* are wedged or urged into contact with the inner mandrel and the inclined elements 19*b* are urged outwardly and pivoted into contact with the casing without significant resilient expansion. Thus relative radial movement of the packing elements under axial compression results from the interaction between the central trapezoidal elements opposing the adjacent inclined elements. Thus, the inclined elements are deformed toward a perpendicular parallelogram cross-section as shown in FIG. 4, as are the wire mesh elements 19*c***. The barrier elements are also pivoted to a position more nearly perpendicular to the axis of the packer to act as a barrier in the annular area to the passage of saturated steam, vapor or moisture.

In order to release the packer, the tubing string and the slick joint 31 can be moved upward until the upper surface of bottom sub 32 is brought into engagement with the lower surface of shearing sleeve 30. Additional tension applied to the tubing string will result in shearing shear screw 28 to release the shearing sleeve for upward movement relative to the shear sleeve retainer 29 and the latch housing 27. Upward movement of shearing sleeve 30 will bring groove **30*b* into alignment with the latching collet heads 26*a* thus permitting inward retraction of the collet. The latching collet 26 will then be released from the latch housing 27 and from the cylindrical housing 24. The axially compressive load applied to the packing element 19 and applied through cone 15 to the rocker type slip 14 will be released permitting upward movement of the mandrel 22 relative to the outer assembly including cone 15. Rocker type slips 14** will thus be moved upward relative to the cones and the entire packer can be removed from the well.

Although the invention has been described in terms of the specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. Packing apparatus for use on a subterranean well tool for sealing the annulus between inner and outer conduits in the presence of steam in a well, the packing apparatus comprising: a plurality of separate annular nonresilient packing elements, further comprising nonresilient fibrous elements and nonresilient bridging material disposed among the fibrous elements, the packing elements being initially disposed in adjacent relationship within an annular encapsulating jacket, said annular encapsulating jacket being disintegratable in the presence of steam in the well; at least one opposing packing element having a radially extending surface inclined relative to the axis of the packing apparatus with the base being wider than the outer periphery, and a plurality of other packing elements having parallel sides and being aligned side-by-side with the inclined surface of said one packing element and being inclined relative to the axis of the packing apparatus, whereby the packing apparatus in surrounding relationship to the well tool, when subjected to axially compressive forces, seals the annulus between the inner and outer conduits, the inclined packing elements being pivoted radially outward without resilient expansion when subjected to axially compressive forces to shift outwardly and establish sealing integrity with the outer conduit and with said one packing element being wedged inwardly to establish sealing integrity with the inner tubular member.

2. The packing apparatus of claim 1 wherein the annular encapsulating jacket comprises a lead-antimony jacket having a melting point lower than the temperature of steam in a well.

3. The packing apparatus of claim 2 further comprising annular wire mesh elements respectively disposed adjacent the axial ends of the annular encapsulating jacket, the annular wire mesh elements comprising means for preventing axial extrusion of the fibrous packing elements to maintain sealing integrity between the inner and outer conduits.

4. The packing apparatus of claim 3 further comprising annular solid impermeable barrier elements disposed between adjacent packing elements.

5. The packing apparatus of claim 1 wherein the fibrous elements comprise intertwined filaments and the bridging material bridges the interstitial gaps between the intertwined filaments to block the passage of steam therethrough.

6. The packing apparatus of claim 5 wherein the bridging material is lubricious.

7. The packing apparatus of claim 6 wherein the fibrous filaments comprise asbestos filaments and the bridging material comprises powdered graphite.

8. The packing apparatus of claim 6 wherein the asbestos filaments are disposed around and supported by metallic wires to enhance the structural integrity of the asbestos filaments.

9. The packing apparatus of claim 8 wherein the nonresilient packing elements comprise die formed compression set elements.

10. The packing apparatus of claim 1 comprising a centrally positioned nonresilient packing element having inclined oppositely directed inclined surfaces with the base being wider than the periphery and a plurality of nonresilient packing elements having parallel sides disposed on opposite sides of the central packing element.

11. A tool for use in sealing the annulus between inner and outer conduits in a subterranean well in the presence of superheated steam, the well tool comprising:

means for positioning the well tool in the well;

opposed packing urging means shiftable from a first to a second position;

packing means positioned between the opposed packing urging means and further comprising a plurality of nonresilient packing elements, the packing elements comprising nonresilient fibrous elements and graphite powder bridging elements disposed among the fibrous elements, a first set of packing elements being disposed adjacent opposing packing element means, the opposing packing element means having at least one inclined surface with the base of the opposing packing element means being wider than the outer periphery; each of the first set of packing elements having parallel sides initially aligned with the adjacent inclined surface of the opposing packing element means and inclined relative to the packing urging means in the first position; the first set of packing elements being pivoted radially outward, without resilient radial expansion, to establish sealing integrity with the outer conduit when the packing urging means are shifted from the first to the second position, and the opposing packing element means being wedged to establish sealing integrity with the inner conduit, whereby said nonresilient packing elements may be radially reoriented to seal the annulus;

impermeable barrier elements between at least a portion of adjacent packing elements, the barrier elements being pivoted when the packing urging means are shifted to block the annular area between the inner and outer conduits; and an annular encapsulating jacket surrounding all of said packing elements and said barrier elements, said jacket being formed of a metal that melts in the presence of steam in the well.

12. The well tool of claim 11 wherein the nonresilient fibrous elements comprise fibrous intertwined filaments.

13. The well tool of claim 12 wherein the bridging elements comprise graphite powder bridging the gaps between the fibrous intertwined filaments.

14. A well tool for use in establishing sealing integrity between inner and outer conduits in a subterranean well in the presence of elevated temperatures and pressure, the well tool comprising:

anchoring means for securing the well tool relative to the outer conduit;

packing means for establishing sealing integrity between the inner and outer conduits;

packing urging means on opposite ends of the packing means for axially compressing the packing means with the packing means being radially urged into sealing contact with the inner and outer conduits, at least one of the packing urging means comprising an elastically stressable cylindrical member having energy storage means therein when the one packing urging means is in axial compression;

means for axially shifting the one packing urging means relative to the anchoring means to place the one seal urging means and the packing means in axial compression;

locking means for retaining the packing means and the one packing urging means in axial compression, whereby the packing means maintain sealing integrity between the inner and outer conduits in the presence of pressure differentials, and whereby inelastic deformation of the packing means, thereby preventing loss of sealing integrity as a result of inelastic deformation of the nonresilient, nonenergizing packing means; said one packing urging means comprising a cylindrical housing abutting the packing means on the exterior of the well tool and the energy storage means is defined by circumferential grooves in the housing, the grooves allowing elastic deformation of the housing under axial compression.

15. The well tool of claim 14 wherein the packing means comprises nonenergizing, nonresilient means.

16. A well tool for use in establishing sealing integrity between inner and outer conduits in a subterranean well in the presence of elevated temperatures and pressure and in the presence of heated steam, the well tool comprising:

anchoring means for securing the well tool relative to the outer conduit;

multi-component, nonresilient, nonenergizing packing means for establishing sealing integrity between the inner and outer conduits, comprising fibrous filament packing elements with wire mesh elements on both ends of the multi-component packing means and nonresilient bridging elements disposed among the fibrous filaments to continuously block fluid passage between the fibrous filaments;

packing urging means on opposite ends of the packing means for axially compressing the packing means with the packing means being radially urged into sealing contact with the inner and outer conduits, at least one of the packing urging means comprising an elastically stressable cylindrical member having energy storage means when the one packing urging means is in axial compression;

means, including a mandrel extending within the packing means, for axially shifting the one packing urging means relative to the anchoring means, to place the one packing urging means and the packing means in axial compression;

an inner tubular member axially reciprocal relative to the mandrel, the inner tubular member being attachable to the inner conduit;

multi-component, nonresilient, nonenergizing sealing means for establishing dynamic sealing integrity between the mandrel and the inner tubular member, comprising sealing element means and fibrous filament sealing elements on opposite ends thereof with wire mesh elements on both ends of the multi-component sealing means;

said laminate sealing element means comprising a dieformed laminate of graphite sheets;

means for applying axial compression to the sealing means to radially urge the sealing means into contact with the mandrel and the inner tubular member, and further comprising a first biasing member attachable to the mandrel and a second energy storage biasing member biased relative to the mandrel, whereby the nonenergizing, nonresilient packing means and sealing means maintain sealing integrity in the presence of pressure differentials and whereby inelastic deformation of the packing means and sealing means due to an increased pressure differential are maintained after reduction of the pressure differential by the stored energy in the packing urging means and the second biasing means respectively thereby preventing loss of sealing integrity as a result of inelastic deformation of the nonresilient, nonenergizing packing and sealing means.

17. A dynamic seal for establishing sealing integrity between reciprocal tubular members in a subterranean well tool in the presence of heated steam, the dynamic seal comprising: first nonresilient sealing element means comprising laminate means having a plurality of thin flat compression set graphite ribbons; second nonresilient sealing element means on opposite sides of the first sealing element means and formed of intertwined fibrous filaments impregnated with powdered graphite; and wire mesh extrusion barrier means disposed on opposite ends of the seal, whereby dynamic sealing integrity is maintained between the reciprocal tubular members by nonresilient means.

18. The dynamic seal of claim 17 wherein the compression set ribbons comprise graphite ribbons, the fibrous filaments comprise carbon filaments, the bridging material comprises powdered graphite, and the extrusion barrier means comprise annular wire mesh elements.

19. The dynamic seal of claim 18 further comprising means for applying compressive end loads to the nonresilient sealing elements to establish sealing integrity between the reciprocal tubular members.

20. The dynamic seal of claim 19 wherein the means for applying compressive end loads comprises spring biasing means.

21. The dynamic seal of claim 18 wherein the first nonresilient sealing element means comprises a plurality of adjacent laminate sealing elements and the second nonresilient sealing element means comprises a plurality of fibrous filament elements.

22. The dynamic seal of claim 21 further comprising solid impermeability barrier elements disposed between adjacent first laminate sealing elements.

23. The dynamic seal of claim 22 further comprising solid impermeability barrier elements between the first nonresilient sealing elements and the second nonresilient sealing element means.

24. The dynamic seal of claim 22 or 23 wherein the impermeability barrier elements comprise ductile metallic elements.

25. A reciprocal expansion joint assembly for use in establishing sealing integrity in a subterranean well in the presence of superheated steam, the expansion joint assembly comprising: first and second concentric mutually reciprocal tubular members; nonresilient sealing means disposed between the reciprocal tubular members for establishing sealing integrity between the first and second tubular members and further comprising a nonresilient dieformed laminate formed of a plurality of thin, flat compression set graphite ribbons, nonresilient fibrous sealing elements means on opposite sides of the laminate sealing element means and formed of carbon filaments impregnated with powdered graphite bridging material, and wire mesh extrusion barrier means disposed on opposite ends of the sealing means; and means for applying compressive end loads to the nonresilient sealing elements, whereby the nonresilient sealing elements are urged into sealing engagement with the reciprocal tubular members.

26. The expansion joint of claim 25 wherein the means for applying compressive end loads comprise energy storage means.

27. The expansion joint of claim 26 wherein the energy storage means comprise spring means.

28. The expansion joint assembly of claim 25 wherein one of the tubular members movable relative to the nonresilient sealing means comprises a cold drawn nonground tubular member.

29. A reciprocal expansion joint assembly for use in establishing sealing integrity in a subterranean well in the presence of heated steam, the expansion joint assembly comprising: inner and outer mutually reciprocal tubular members; nonresilient nonenergizing sealing means disposed between the reciprocal tubular members for establishing sealing integrity therebetween; energy storage means for applying a compressive end load on one end of the nonresilient sealing means, one end of the energy storage means abutting a shoulder on the outer tubular member with the other end biasing the nonresilient sealing means; and engaging means securable to the outer conduit on the opposite end of the nonresilient sealing means and engaging the opposite end thereof; the engagement between the engaging means and outer tubular member being adjustable after the energy storage means and the nonresilient sealing means are positioned between the inner and outer tubular member to preload and energize the energy storage means and the nonresilient seal means, whereby sealing integrity is established between the inner and outer tubular members.

30. The reciprocal expansion joint assembly of claim 29 wherein the energy storage means comprises spring means.

31. A reciprocal expansion joint assembly for use in establishing sealing integrity in a subterranean well in the presence of heated steam and with a pressure differential acting in a first direction, the expansion joint assembly comprising: inner and outer mutually reciprocal tubular members; nonresilient, nonenergizing sealing means disposed between the reciprocal tubular members for establishing sealing integrity therebetween; energy storage means for applying a compressive end load on the high pressure end of the nonresilient sealing means, one end of the energy storage means abutting a shoulder on the outer tubular member with the other end biasing the nonresilient sealing means; and engaging means securable to the outer conduit on the opposite end of the nonresilient sealing means and engaging the opposite end thereof, the engagement between the engaging means and outer tubular member being adjustable, after the energy storage means and the nonresilient sealing means are positioned between the inner and outer tubular members, to energize the energy storage means and the nonresilient seal means, whereby sealing integrity is established between the inner and outer tubular members, and whereby when increasing pressure differentials further axially compress the nonresilient sealing elements, the energy storage means maintaining compressive end loads on the nonresilient seal upon reduction of the pressure differential.

32. The expansion joint assembly of claim 31 wherein the energy storage means comprise spring means.

33. Packing apparatus for use on a subterranean well tool for sealing the annulus between inner and outer conduits in the presence of steam in a well, the packing apparatus comprising: a plurality of separate annular nonresilient packing elements initially disposed in adjacent relationship within an annular encapsulating jacket, the jacket formed of a material disintegrable in the presence of steam in a well, the packing elements having parallel sides and being aligned side-by-side with the inclined surface of the opposing packing element and being inclined relative to the axis of the packing apparatus, whereby the packing apparatus in surrounding relationship to the well tool, when subjected to axially compressive forces, seals the annulus between the inner and outer conduits, the inclined packing elements being pivoted radially outward without resilient expansion when subjected to axially compressive forces to shift outwardly and establish sealing integrity with the outer conduit.

34. A multi-component dynamic seal for establishing sealing integrity between reciprocal tubular members in a subterranean well tool in the presence of heated steam, the dynamic eal comprising: an axial stack of annular nonresilient sealing elements each comprising a dieformed laminate formed of a plurality of thin flat compression set ribbons of graphite; wire mesh extrusion barrier means disposed on opposite ends of the mutli-element stack; and solid impermeability barrier elements disposed between adjacent nonresilient sealing elements and extending radially between reciprocal tubular members whereby dynamic sealing integrity is maintained between the reciprocal tubular members by nonresilient means.

35. Packing apparatus for use on a subterranean well tool for sealing the annulus between inner and outer conduits in the presence of steam in a well, the packing apparatus comprising: a plurality of separate annular nonresilient packing elements disposed in said annulus in axially stacked relation, each of said packing elements being primarily formed of graphite which is dieformed into an initial annular configuration having an external diameter less than the bore diameter of the outer conduit and an internal diameter permitting telescopic mounting of the packing element on the inner conduit; at least one packing element having a radially extending surface inclined relative to the axis of the conduits, a plurality of other said packing elements having an inclined parallelogram cross-section of the same inclination as said inclined radial surface of said one packing element, whereby the application of an axial compressive force to said stack of packing elements causes said one packing element to non-resiliently deform radially inwardly to seal against the inner conduit and said other packing elements to deform toward a rectangular parallelogram cross-section to non-resiliently move into sealing engagement with the bore of the outer conduit; and an annular encapsulating jacket surrounding said stack of sealing elements, said jacket being meltable in the presence of steam in the well.

36. The packing apparatus of claim 35 wherein the annular encapsulating jacket comprises a lead-antimony jacket having a melting point lower than the temperature of steam in a well.

37. The packing apparatus of claim 35 further comprising annular solid impermeable barrier elements disposed between adjacent packing elements.

38. The packing apparatus of claim 35 wherein the nonresilient packing elements comprise dieformed compression set elements.

39. The packing apparatus of claim 35 wherein said one annular packing element has a trapezoidal cross-sectional configuration with the inner wall portion being axially wider than the outer wall portion whereby the side walls are oppositely inclined, said one annular packing element being located centrally in said stack and said other annular packing elements being disposed above and below said one packing element.

* * * * *